US006173777B1

(12) United States Patent
Mullins

(10) Patent No.: US 6,173,777 B1
(45) Date of Patent: Jan. 16, 2001

(54) SINGLE VALVE FOR A CASING FILLING AND CIRCULATING APPARATUS

(76) Inventor: Albert Augustus Mullins, 18706 Arcaro Glen Ct., Humble, TX (US) 77346

( * ) Notice: Under 35 U.S.C. 154(b), the term of this patent shall be extended for 0 days.

(21) Appl. No.: 09/249,568

(22) Filed: Feb. 9, 1999

(51) Int. Cl.[7] ..... E21B 33/068
(52) U.S. Cl. ..... 166/285; 166/177.4; 166/387
(58) Field of Search ..... 166/117.4, 285, 166/334.4, 187, 387, 85.3, 85.5

(56) References Cited

U.S. PATENT DOCUMENTS

| | | |
|---|---|---|
| 1,662,311 | 3/1928 | Hamer . |
| 1,866,726 | 7/1932 | Santiago . |
| 2,223,388 | 12/1940 | Scaramucci . |
| 2,620,037 | 12/1952 | McClendon . |
| 3,361,453 | 1/1968 | Brown et al. . |
| 3,863,716 | 2/1975 | Streich . |
| 3,915,226 | 10/1975 | Savage . |
| 4,076,083 | 2/1978 | Sizer . |
| 4,100,968 | 7/1978 | Delano . |
| 4,246,967 | 1/1981 | Harris . |
| 4,290,482 | 9/1981 | Brisco . |
| 4,522,430 | 6/1985 | Stromberg . |
| 4,524,998 | 6/1985 | Brisco . |
| 4,566,168 | 1/1986 | Stromberg . |
| 4,613,161 | 9/1986 | Brisco . |
| 4,624,483 | 11/1986 | Stromberg . |
| 4,655,286 | 4/1987 | Wood . |
| 4,718,495 | 1/1988 | Lubitz et al. . |
| 4,817,724 | 4/1989 | Funderburg, Jr. et al. . |
| 4,913,231 | 4/1990 | Muller et al. . |
| 4,997,042 | 3/1991 | Jordan et al. . |
| 5,044,444 | 9/1991 | Coronado . |
| 5,152,554 | 10/1992 | LaFleur et al. . |
| 5,191,939 | 3/1993 | Stokley . |
| 5,236,035 | 8/1993 | Brisco et al. . |
| 5,249,629 | 10/1993 | Jennings . |
| 5,282,653 | 2/1994 | LaFleur et al. . |
| 5,411,095 | 5/1995 | Ehlinger et al. . |
| 5,413,171 | 5/1995 | Womack . |
| 5,435,390 | 7/1995 | Baugh et al. . |
| 5,441,310 | 8/1995 | Barrett et al. . |

(List continued on next page.)

FOREIGN PATENT DOCUMENTS

WO93/07358 4/1993 (WO) .

OTHER PUBLICATIONS

B. J. Hughes Brochure, "Subsea Cementing Systems", p. 600.

(List continued on next page.)

*Primary Examiner*—Frank Tsay
(74) *Attorney, Agent, or Firm*—Duane, Morris & Heckscher LLP

(57) ABSTRACT

A casing or tubular fill and circulator assembly is indicated, wherein a singular valve is used for filling and circulating the casing as well as providing for pressure equalization when the singular valve is in the open position. The valve is constructed so that it is opened upon being inserted into the upper end of the casing. For filling the casing, only the valve is inserted into the upper end of the casing whereupon the valve is fully opened so that fluid can be pumped into the casing without a pressure drop or erosion of any of the valve members. For circulation, the apparatus is advanced further into the casing until a cup seal closes off the top of the casing. Once flow is initiated in that condition, internal pressure in the casing, at very low applied pressures, will begin the circulation through the casing. With the valve in the fully open position, erosive effects from flow are eliminated during filling and circulation. Additionally, with the cup seal in the casing and the valve fully open, the pumps can be stopped and pressure equalization will occur through the fully opened valve without restriction or delay.

23 Claims, 2 Drawing Sheets

U.S. PATENT DOCUMENTS

| | | | |
|---|---|---|---|
| 5,443,122 | 8/1995 | Brisco . | |
| 5,499,687 | 3/1996 | Lee . | |
| 5,501,280 | 3/1996 | Brisco . | |
| 5,553,667 | 9/1996 | Budde et al. . | |
| 5,577,566 | 11/1996 | Albright et al. | 175/321 |
| 5,584,343 | 12/1996 | Coone . | |
| 5,641,021 | 6/1997 | Murray et al. . | |
| 5,660,234 | 8/1997 | Hebert et al. . | |
| 5,735,348 | 4/1998 | Hawkins, III . | |

OTHER PUBLICATIONS

B&W Incorporated Brochure, "B&W Rotating Surface Casing Cementing Method", p. 502.

B&W Incorporated Brochure, "Gravel Compaction", pp. 509–510.

TAM International Brochure, "TAM Casing Circulating Packer", 1991.

Frank's Casing Crew & Rental Tools, Inc., Brochure, "HiTop Model FC–1 Fill–Up/Circulation Tool".

Frank's Casing Crew & Rental Tools, Inc., Technical Manual, "HiTop Oil Tools", Rev. A, Mar. 2, 1995.

Frank's Casing Crew & Rental Tools, Inc., Technical Manual, "HiTop Oil Tools", Rev. A, Feb. 28, 1995.

TAM International Article, Running Procedure for 11" & 7" O.D. Casing Circulating Packer Fill–Up, 13 3/8" & 9 5/8" Casing, Mar. 9, 1993, pp. 1–2.

LaFleur Petroleum Services, Inc., Procedural Brochure, "Autoseal Circulating Head", Apr. 25, 1995, pp. 1–10.

Wassenborg, M., "Franks FC–1 Circulation Packer Washes 13 5/8" Casing to Bottom", The Brief, Jun. 1995.

Halliburton Services, Technical Drawing #3481.

Davis–Lynch, Equipment Catalog No. 11, 1993, 866–895.

Halliburton Information, Oil & Gas Journal, p. 12.

Composite Catalog, 1965, "Brown Hyflo Liner Packers", p. 944 PBL Drilling Tools, Ltd., Brochure, Hydro Mechanical Casing Circulator.

Composite Catalog, "Brown Duo–Packer", p. 919.

Composite Catalog, Baker Packers, "Waterflood Systems", p. 701.

Composite Catalog, Arrow Oil Tools, Inc., Retrievable Bridge Plug, p. 296.

Composite Catalog, Bowen Power Equipment, Bowen Power Swivels, pp. 565, 567.

Wepco Brochure, "Hydraulically Operated Circulation Head" Miscellaneous information on Davis–Lynch, Inc. Fill and Circulate (FAC) Tool for Top Drive Drilling Systems, 2 pages, date unknown.

Halliburton Services, information on Quick–Latch Coupler Head, Oil & Gas Journal, 1 page, Oct. 1988.

Misc. information on Halliburton Services Plug Containers, Selective Release Plug System and SSR(Sub–Surface Release)Cementing Plug Method, 4 pages, date unknown.

Frank's International, Brochure on Fill–Up & Cementing Tool System and FC–1 Fill–Up & Circulating Tool With Sliding Sleeve, 2 pages, date unknown.

Frank's Hilltop, drawings, 5 pages, date unknown.

HiTop Oil Tools, Misc. information on Model FC–1 Fill–Up Circulation Tool, 2 pages, date unknown.

Drawing of Lafleur Petroleum Services AutoSeal Circulating Head, 1 page, date unknown.

Misc. information on Tam International Casing Circulating Packers, 8 pages, date unknown.

Guiberson Type GW Packer Cup; p. 1964 (1950 Composite).

Page Oil Tools, Inc. Bottom Hole Oil and Gas Separator ; p. 3965 (1950 Composite).

McGaffey–Taylor Corp., Oil Well Service; M& T Shoe Squeeze Tool; pp. 3634–3635; (1960 Composite).

Guiberson, GW Cup Type Packers; p. 2176; (1966/67).

Guiberson, Typical GW Packer Applications; p. 2177; (1966/67).

Guiberson, Type SJ Circulating Slide Valve; p. 2183; (1966/67).

Page Oil Tools, Page Forced Flow Downhole Separator, p. 3959; (1966/67).

SINGLE VALVE FOR A CASING FILLING AND CIRCULATING APPARATUS

FIELD OF THE INVENTION

The field of this invention relates to filling casing while it is being run in the hole and circulating it to aid in its proper positioning as it is being advanced into the wellbore.

BACKGROUND OF THE INVENTION

Casing for a wellbore that has just been drilled is assembled at the surface as joints are added and the string is lowered into the wellbore. As the joints are added at the surface on the rig floor, it is desirable to fill the casing. Filling the casing before it is run into the wellbore prevents pressure imbalances on the casing as it is being advanced into the wellbore. Additionally, once the casing is filled, it may be desirable to circulate through the casing as it is being run into the wellbore. Prior devices have been developed to fill the casing and to circulate it. These devices used in the past are illustrated in U.S. Pat. Nos. 4,997,042; 5,191,939; and 5,735,348. These devices illustrated in these patents employed sealing elements which would seat against the inside of the casing, followed by a mechanical setdown force which opened ports to allow for circulation. Seals between a mandrel and a movable sleeve were also needed to retain a sealed connection to allow circulation. Filling in these devices was accomplished by displacement of a valve member past a lateral port to expose the lateral port to allow the casing to fill. One of the problems with the prior designs is that excessive erosion occurred at the valve member used for filling the casing, undermining its reliability. Additionally, these previous designs require at least two separate valves, one for filling the casing and the other for circulating the casing. In order to circulate with the prior designs, not only did a sealing element have to get a good sealing grip on the inside of the casing, but also the circulating ports had to be mechanically exposed using setdown weight. The configuration and nature of the operation of these prior designs made them prone to erosion. Additionally, these previous designs require additional valve components to allow pressure equalization when the pumps are stopped after circulation.

Accordingly, it is an object of the present invention to provide a system that simplifies the construction of the apparatus useful for filling aid circulating casing. Accordingly, the fill and circulation valves have been designed as a singular unit which substantially provides a large flowpath to minimize erosive effects and simplify the operation. Another object of the apparatus is to eliminate the use of any additional valves required for pressure equalization when the pumps are turned off and to simplify the design and the cost of constructing the apparatus. To facilitate the operation of the apparatus, the single valve has been configured to easily open fully. These and other objectives accomplished by the apparatus will become more apparent from a review of the detailed description below.

SUMMARY OF THE INVENTION

A casing or tubular fill and circulator assembly is indicated, wherein a singular valve is used for filling and circulating the casing as well as providing for pressure equalization when the singular valve is in the open position. The valve is constructed so that it is opened upon being inserted into the upper end of the casing. For filling the casing, only the valve is inserted into the upper end of the casing whereupon the valve is fully opened so that fluid can be pumped into the casing without a pressure drop or erosion of any of the valve members. For circulation, the apparatus is advanced further into the casing until a cup seal closes off the top of the casing. Once flow is initiated in that condition, internal pressure in the casing, at very low applied pressures, will begin the circulation through the casing. With the valve in the fully open position, erosive effects from flow are eliminated during filling and circulation. Additionally, with the cup seal in the casing and the valve fully open, the pumps can be stopped and pressure equalization will occur through the fully opened valve without restriction or delay.

DETAILED DESCRIPTION OF THE PREFERRED EMBODIMENT

Figure 1:
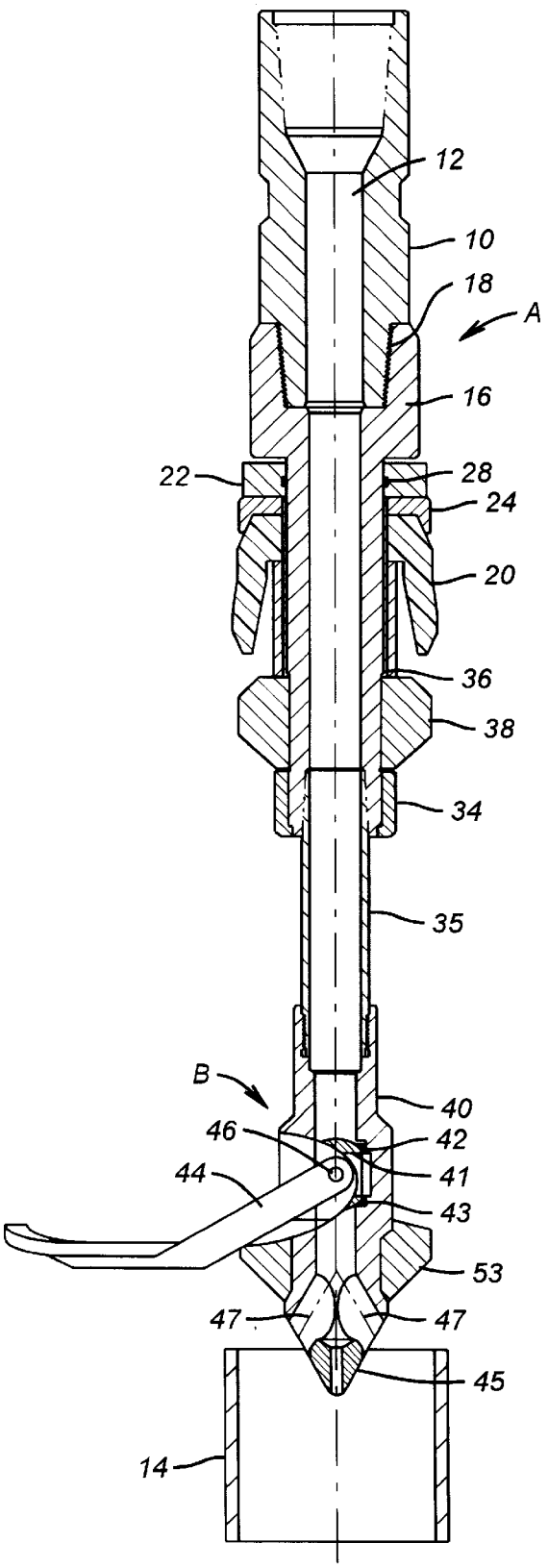
FIG. 1 is a sectional elevational view of the apparatus with the singular valve in the closed position.

Referring to FIG. 1, the apparatus A is supported from the top drive (not shown) and has a top sub 10 with an internal passage 12. Internal passage 12 is connected to the mud pumps (not shown) for filling and circulating of the casing 14. Top sub 10 is connected to body 16 at thread 18. A cup seal 20 is mounted to sleeve 22 with support ring 24 mounted in between. Seal 28 seals between rotating sleeve 22 and stationary body 16. Gage ring 38 is mounted on body 16 and positions the apparatus A in nearly the center of the casing 14 to facilitate easy insertion of the apparatus into the upper end of the casing. Sleeve 36 holds cup seal 20 in place while nut 34, which is attached to body 16, retains gage ring 38, sleeve 36, cup seal 20, support ring 24, and sleeve 22 in relative loose position on body 16. Body 16 is connected to spacer 35 which provides an extension to passage 12. Valve body 40 is attached to spacer 35. The size of valve body 40 can be larger than spacer 35 so that even with valve member 41 not fully open, the flow passage is still equal to or larger through valve body 40 than passage 12. Valve member 41 (ball valve) shown closed is held in position within valve body 40 with upper valve seal 42, lower valve seal 43, and bottom sub 45. The valve can be of many different types, such as plug, sleeve, or butterfly, to name a few options. Valve arm 44 is attached to the valve stem 46 at the exterior of the valve body 40. Valve stem 46 is attached to valve member 41 to control the open/closed rotational position of valve member 41. Gage ring 53 nearly centers the valve B in the casing and protects valve arm 44 during insertion into the upper end of the casing. Tubulars other than casing may be used with the present invention. Casing is intended to cover tubulars such as production tubing and drillpipe and lines. This centering effect ensures that the arm or lever 44 will rotate about 90° or sufficiently to open the valve. Valve arm 44 shown with the valve member 41 in the closed position is rotationally limited by its contact with gage ring 53. The weight of the valve arm 44 and rotational torque to move valve member 41 can be such that the weight of the valve arm 44 will rotate the valve member 41 to the closed position when the valve is not inserted into the casing 14. A spring assist is also possible.

Figure 2:
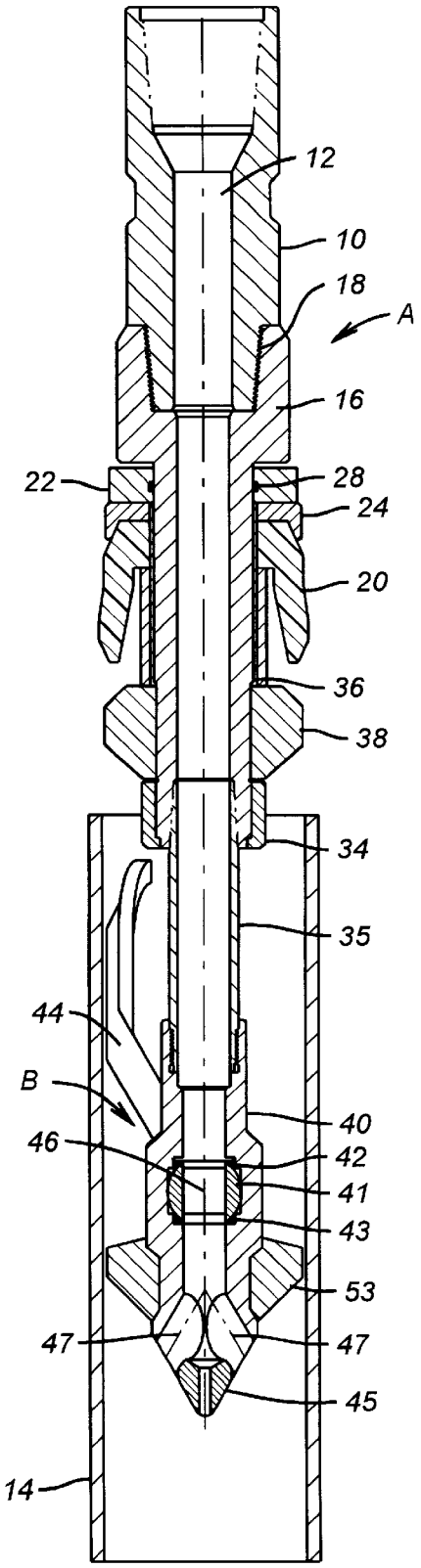
FIG. 2 is the view of FIG. 1, with the singular valve inserted into the casing and in the open position for filling the casing.

Referring to FIG. 2, the apparatus A is lowered so that the valve B is fully inserted into the upper end of the casing 14.

As the apparatus A is lowered, the bottom sub 45 will be positioned near the center of the casing and gage ring 53 will further center the valve B, valve arm 44 will be rotated by contact with the upper end of the casing 14 so as to fully open valve member 41 when the valve arm 44 is fully inserted in the casing 14. In this position the pumps can be started and the casing 14 filled as the fluid flows through the passage 12, through the fully opened valve member 41 and out the ports 47. There is no restriction in this flow passage since the valve member 41, when in the fully opened position, has a bore size that equals or exceeds bore 12 or any port 47.

Figure 3:
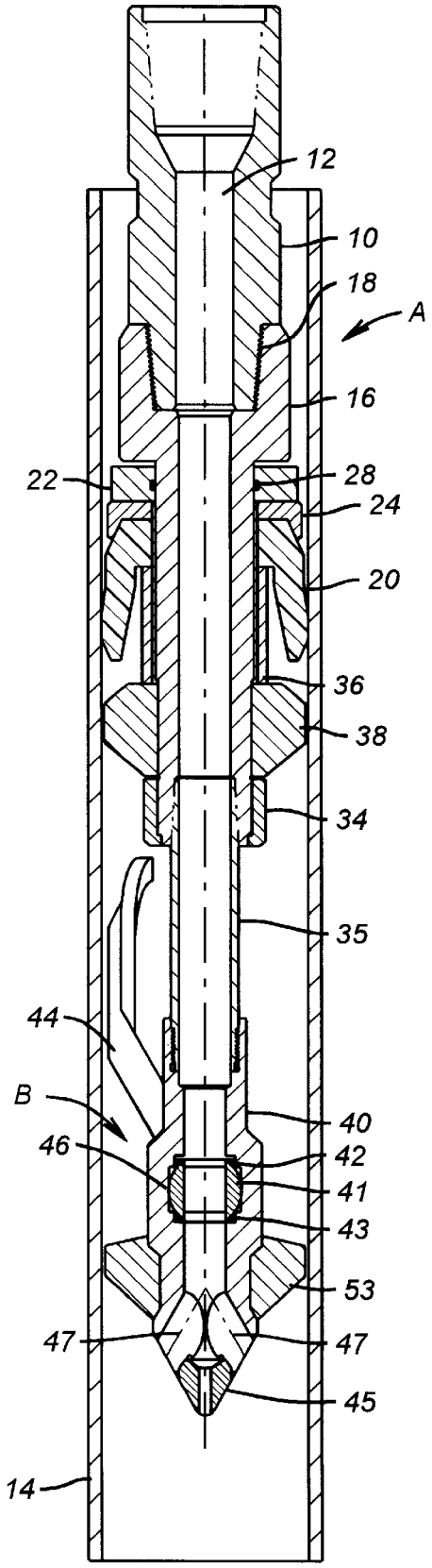
FIG. 3 is the view of FIG. 2, except that the apparatus has been advanced into the casing to seal against its inside diameter and the valve is in the fully opened position for circulation and subsequent pressure equalization.

Referring now to FIG. 3, the apparatus A and valve B are further lowered so that the cup seal 20 engages the inside of the casing 14. In this position, when the mud pumps are again turned on, the fluid passes through the passage 12 through the fully opened valve member 41 and out the ports 47. Since the upper end of the casing 14 is now closed off by cup seal 20, pressure develops in the casing 14, and circulation of the casing can occur as pressure from the mud pumps is forced down to the bottom of the casing and out and around its exterior back to the surface. This process may be repeated for each stand of casing that is added. Those skilled in the art will appreciate that while cup seals have been shown for the sealing mechanism 20, other types of seals can be used without departing from the spirit of the invention. Additionally, the configuration of the valve internals within body 40 can be altered without departing from the spirit of the invention. Thus, instead of using a ball valve, other types of valve members can be used to control the flow of fluid through the invention. It is desirable for the valve member 41 in body 40 to be in the closed position when the rig pumps are not running so that residual mud within the passage 12 does not spill on the rig floor when the valve B is extracted from the top of the casing. Another feature of the valve B is that prior to pulling the cup seal 20 out of the casing after circulating the casing and prior to adding another section of casing, the valve member 41 allows complete, unrestricted venting of any excess pressure out through ports 47 and passage 12 where, at a location near the rig pumps (not shown), the pressure is automatically relieved. Thus, another purpose of the valve member 41 is to prevent rig personnel from pulling the cup seals 20 out of the casing 14 while there is pressure in the annular space 73.

The foregoing disclosure and description of the invention are illustrative and explanatory thereof, and various changes in the size, shape and materials, as well as in the details of the illustrated construction, may be made without departing from the spirit of the invention.

What is claimed:

1. A casing or tubular fill up and circulating tool, comprising:

a body having an internal passage leading to at least one outlet port adjacent a lower end of said body;

a seal mounted externally to said body;

a valve in said internal passage, said valve movable between an open and closed position in response to insertion, at least in part, and substantial removal of said body, respectively, as to the casing or tubular.

2. The tool of claim 1, further comprising:

an actuator on said valve extending externally to said body where it can engage the casing or tubular on insertion, at least in part, of said body.

3. The tool of claim 2, wherein:

said actuator comprises a lever that rotates in a first direction sufficiently upon insertion, at least in part, of said body so as to place said valve in said open position.

4. The tool of claim 3, wherein:

said lever rotates in a second direction opposite said first direction upon withdrawal of said body from the casing or tubular.

5. The tool of claim 4, wherein:

the weight of said lever forces it to rotate in said second direction upon withdrawal of said body from the casing or tubular.

6. The tool of claim 5, wherein:

said lever is biased toward movement in said second direction.

7. The tool of claim 3, wherein:

said valve remains open with said body inserted in part into the casing or tubular, regardless of the level of internal pressure in said internal passage.

8. The tool of claim 2, further comprising:

a ring mounted to said body to assist in centralizing it in the casing or tubular and to protect said actuator as it is inserted into the casing or tubular.

9. The tool of claim 2, wherein:

said actuator is rotated to about 90° due to its contact with the casing or tubular, said actuator entering the casing or tubular as said body is lowered further.

10. The tool of claim 1, wherein:

said valve having a cross-sectional area in its open position equal to or greater than the minimum cross-sectional area of said internal passage.

11. The tool of claim 1, wherein:

said valve positioned open for fill up when said seal is not in contact with the casing and said body is inserted, at least in part, in the casing or tubular, said valve positioned open for circulation and subsequent equalization of pressure with said seal in contact with the casing or tubular.

12. A method of filling and circulating casing or tubular, comprising:

lowering a body having an external seal and a passage therethrough at least in part into the casing or tubular, without contact of the casing or tubular by said seal;

providing a valve in said passage;

opening said valve solely as a result of said lowering.

13. The method of claim 12, further comprising:

providing a passage through said valve at least as large in cross-sectional area as said through passage in said body.

14. The method of claim 12, further comprising:

further lowering said body to bring said external seal into contact with the casing or tubular;

maintaining said valve open during said further lowering.

15. The method of claim 14, further comprising:

circulating through said passage in said body with pressurized fluid;

using said seal to prevent fluid escape from the casing or tubular during said circulating;

equalizing pressure through said valve after removing said pressurized fluid.

16. The method of claim 12, further comprising:

filling casing or tubular through said open valve.

17. A method of filling and circulating casing or tubular, comprising:

lowering a body having an external seal and a passage therethrough at least in part into the casing or tubular, without contact of the casing or tubular by said seal;

providing a valve in said passage;

opening said valve as a result of said lowering;

providing an actuator for said valve mounted externally to said body;

operating said valve by engagement of said actuator with the casing or tubular.

18. The method of claim 17, further comprising:

providing a lever as said actuator;

rotating said lever by its contact with the casing or tubular.

19. The method of claim 18, further comprising:

rotating said lever to a fully open position of said valve by said lowering of said body.

20. The method of claim 19, further comprising:

using the weight of said lever for closure of said valve upon raising said body.

21. The method of claim 20, further comprising:

biasing the lever toward the closed position of said valve.

22. The method of claim 19, further comprising:

inserting said lever into the casing or tubular as a result of said lowering.

23. The method of claim 19, further comprising:

providing a ring on said body to assist in centralizing said body in the casing or tubular;

using said ring to protect said lever when said lever is advanced into the casing or tubular.

* * * * *